United States Patent [19]

Satoh et al.

[11] Patent Number: 4,730,204

[45] Date of Patent: Mar. 8, 1988

[54] COPYING MACHINE WITH AUTOMATIC ORIGINAL FEEDING DEVICE

[75] Inventors: Fumio Satoh, Habikino; Kazuo Takahashi, Osaka, both of Japan

[73] Assignee: Sharp Kabushiki Kaisha, Osaka, Japan

[21] Appl. No.: 850,014

[22] Filed: Apr. 10, 1986

[30] Foreign Application Priority Data

Apr. 11, 1985 [JP] Japan ..... 60-54660[U]
Apr. 16, 1985 [JP] Japan ..... 60-82966

[51] Int. Cl.[4] ..... G03G 15/00
[52] U.S. Cl. ..... 355/14 SH; 355/14 R; 271/121
[58] Field of Search ..... 355/14 SH, 14 R, 14 CU, 355/3 SH; 271/3.1, 245, 275, 258, 259, 264, 256, 167, 121, 122, 125

[56] References Cited

U.S. PATENT DOCUMENTS

| | | | |
|---|---|---|---|
| 3,966,189 | 6/1976 | Taylor et al. | 271/167 X |
| 4,074,902 | 2/1978 | Bradbury | 271/167 X |
| 4,372,673 | 2/1983 | Tomosada et al. | 355/14 R |
| 4,417,350 | 11/1983 | Ito et al. | 355/14 C UX |
| 4,422,751 | 12/1983 | Komiya et al. | 355/14 SH |
| 4,497,569 | 2/1985 | Booth | 355/14 R |
| 4,568,074 | 2/1986 | Murayoshi | 271/121 |

FOREIGN PATENT DOCUMENTS

| | | | |
|---|---|---|---|
| 60-36238 | 2/1985 | Japan | 271/121 |

*Primary Examiner*—A. C. Prescott
*Attorney, Agent, or Firm*—Birch, Stewart, Kolasch, & Birch

[57] ABSTRACT

Disclosed is a copying machine provided with a device for detecting a jammed original in the original-conveying path and a device that first discharges copying papers during image-transference process from the copying mechanism upon detection of paper jamming and then causes the value of the copied-paper counter to return to the value displayed before the jamming.

3 Claims, 6 Drawing Figures

COPYING MACHINE WITH AUTOMATIC ORIGINAL FEEDING DEVICE

BACKGROUND OF THE INVENTION

The present invention relates to an automatic original feeding device used in an office apparatus such as a copying machine or facsimile to allow the copying paper during an image-transference process to be discharged automatically from the copying mechanism when the original jams in the original-conveying path. Simultaneously, the value of the copied-paper counter returns to the value displayed before the paper jammed.

In any conventional copying machine capable of automatically feeding an original to the light-exposure position via the original-conveying path, a copying paper is fed synchronous with the original-conveying timing during the image transference process of copying. Such conventional copying machines simultaneously stop the operation of the original-conveying path and the copying mechanism when the original jams in the original-conveying path (including the light exposure position). Consequently, if the original jams in the original-conveying path, the operator must first manually remove the jammed original from the path and then manually remove the copying paper from the image transference section of the copying mechanism. This painstaking task wastes much time.

SUMMARY OF THE INVENTION

In light of the disadvantages currently present in conventional copying machines, the present invention aims at providing a novel copying machine incorporating means for automatically discharging copying paper which is under the image-transference process when paper jamming is detected in the original-conveying path and causing the copied-paper counter to automatically reset to the counter value displayed before the jamming took place. This feature automatically and easily removes jammed paper from the system and corrects the value of the copied-paper counter.

Another object of the present invention is to provide an automatic original feeding device that effectively prevents the leading edge of the original from being folded or damaged during conveyance by applying means for guiding the original between the rollers.

In brief, the present invention provides a novel copying machine incorporating an automatic original feeding device which includes means for detecting jammed paper in the original conveying path and means for causing the copying mechanism to discharge automatically a copying paper in the transference process and simultaneously cause the copied-paper counter to reset to the value displayed before the paper jammed.

A further objective of the present invention is to provide a copying machine with an automatic original feeding device incorporating a forward rotating paper feeding roller and a paper-reverse rotating double-feeding prevention roller which are face to face. The original is fed between these facing rollers. In this automatic original feeding device, means for guiding the leading edge of the incoming original between the rollers without contacting the reverse-rotating roller is also provided.

BRIEF DESCRIPTION OF THE DRAWINGS

The present invention will be better understood from the detailed description given below and the accompanying drawings which are given by way of illustration only, and thus are not limitative of the present invention wherein.

DESCRIPTION OF THE PREFERRED EMBODIMENTS

Referring now to the accompanying drawings, the preferred embodiments of the present invention are described below.

Figure 1:
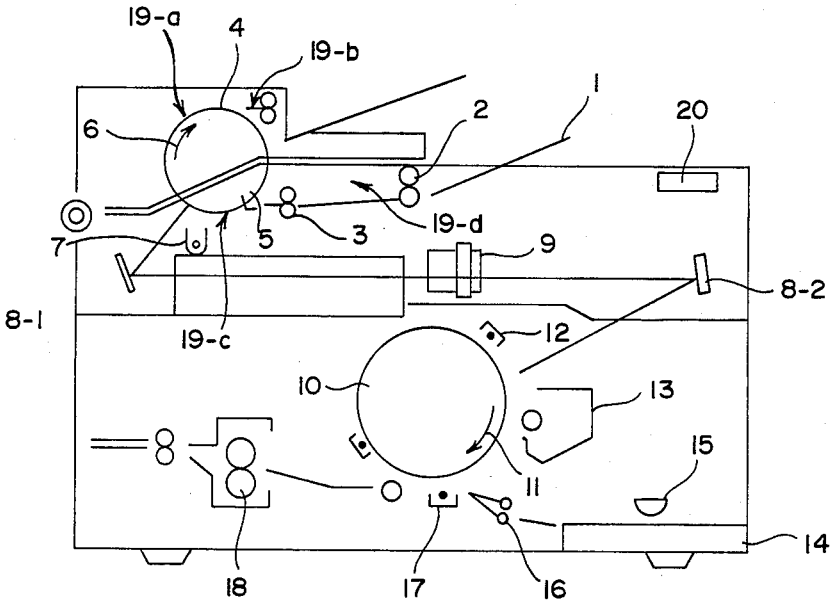
FIG. 1 is a simplified diagram of the automatic original feeding device reflecting the first preferred embodiment of the present invention.

FIG. 1 is a simplified diagram of the automatic original feeding device reflecting the first preferred embodiment. When the PRINT button (not shown) is first pressed, a pair of original feeding rollers 2 start to rotate, delivering the original from an original tray 1 via the original feeding path until the original comes into contact with a pair of stationary DS rollers 3. After the inclined posture of the original is corrected, DS rollers 3 are activated to deliver the original to an original-winding drum 4. The leading edge of the original from the DS rollers 3 is caught by a claw 5 provided on the original-winding drum 4, which then starts rotating in the arrowed direction 6 to wind the original onto the drum. While the winding operation is underway, the original surface is illuminated by a light-source 7 that lights up synchronous with detection of the leading edge of the original. The light reflected from the surface of the original is projected onto the surface of the photoreceptive drum 10 via a mirror 8-1, lens 9, and another mirror 8-2. Since the photoreceptive drum 10 being charged by a charger 12 rotates in the arrowed direction 11 synchronous with the original-winding drum 4, the data conveyed by the reflected light from the original surface is sequentially formed on the photoreceptive drum 10 as a photoelectric latent image, which is then visualized by a developer unit 13.

The copying paper stored in a cassette 14 is individually fed into the copying machine by a paper-feeding roller 15. Then, like the original, the inclined posture of the copying paper is corrected by a pair of PS rollers 16 which then start to rotate synchronous with the arrival of the leading edge of the original wound on the drum 4, allowing the copying paper to be delivered to a image transference unit 17. A visual image of the original formed on the photoreceptive drum 10 is then transferred to the copying paper. The transferred image is fixed onto the copying paper by an image-fixer 18 before eventually being drawn out of the copying mechanism. When one full copying cycle is completed, a copied-paper counter 20 counts up one value. When a designated number of sheets have been copied, the claw 5 on the original-winding drum 4 is released to allow the original to be delivered to the discharge tray (not shown). The reference numerals **19-*a* through 19-*d*** denote the original detection sensors which detect paper jammed in the conveying path.

Figure 2:
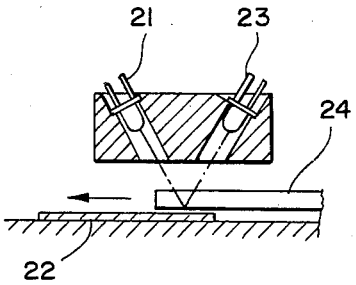
FIG. 2 is a schematic diagram of the original detection sensor.

FIG. 2 is one example of a light-reflective original-detection sensor. Light from a light projector 21 is reflected by a reflection panel 22 and the reflected light is received by a light receiver 23. Paper detection sensors detect the presence of an original 24 when it intercepts the reflected light. Using each sensor positioned as shown in FIG. 2, the original-detected time and the original-retained time are then compared to predetermined values so that the original-detection sensors **19-*a* through 19-*d* can correctly detect paper jamming in the automatic original feeding device (ADF). For example, the controller system itself identifies paper jamming if either sensor 19*b*** cannot detect an "original present" signal even when the original discharge process has been entered or if these sensors cannot detect an "original present" signal at specific intervals during the continuous copying mode.

Figure 3:
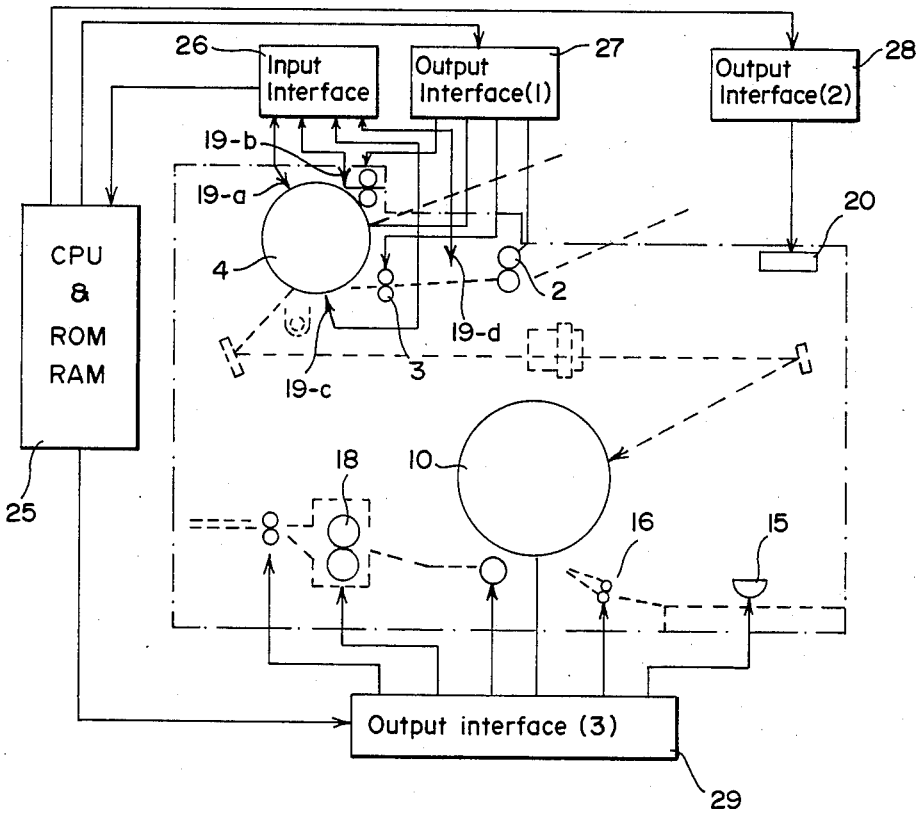
FIG. 3 is a simplified diagram of the controller unit.
Figure 4:
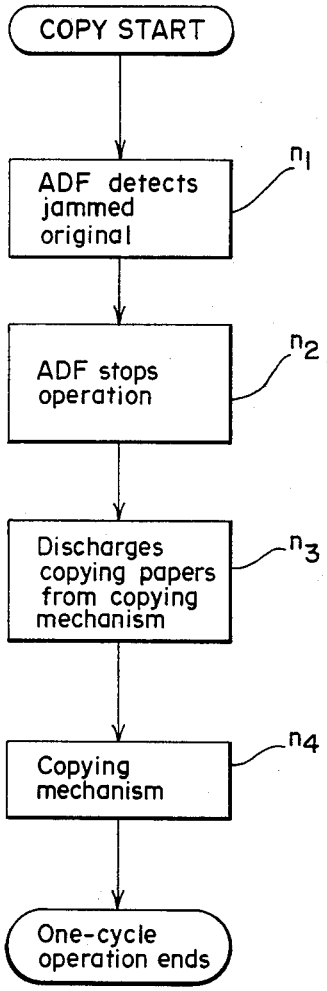
FIG. 4 is an operation flowchart of the controller unit.

FIGS. 3 and 4 are, respectively, simplified diagrams of the controller unit and its control operation flowchart. Referring now to these figures, operation of the automatic original feeding device related to the present invention is described below.

In FIG. 3, the reference numeral 25 represents a controller unit comprised of a central processing unit (CPU) and memory including a ROM and a RAM. The reference numeral 26 represents an input interface for feeding the original-detected signal from the original-detection sensors **19-*a* through 19-*d* to the controller unit 25. The reference numerals 27 through 29 represent output interfaces for delivering various control signals from the controller unit 25 to the automatic original feeding device, a copied-paper counter 20**, and the copying mechanism, respectively.

Referring now to the operation flowchart shown in FIG. 4, operations of the copying machine incorporating the preferred embodiments are described below. When the original detection sensors **19-*a* through 19-*d* detect that the paper is jammed in the original-conveying path of the automatic original feeding device during step n1, the controller unit 25 outputs a specific control signal to the copied-paper counter 20 via the output interface 28 so that the value of the counter 20 resets to the value displayed before the jam, simultaneously causing the rotations of the original-feeding rollers 2, original-support rollers 3, and the original-winding drum 4 to stop during step n2. Then, after completely discharging those copying papers which were already delivered to the image-transference unit of the copying mechanism when the original jammed (step n3), the controller unit 25 stops the operation of the copying mechanism during step n4**. Thus, the copying machine reflecting the first preferred embodiment first stops the automatic paper feeding operation simultaneous with the occurrence of a paper jam, and then causes the copied-paper counter value to return to the value displayed before the jamming took place while allowing the copying mechanism to be operated continuously. The copying operation stops only after all copying paper is completely discharged from the copying machine. This dispenses with the manual work usually needed to remove copying paper from the copying mechanism and to correct the value of the copied-paper counter. As is clear from the foregoing description, according to the first preferred embodiment of the present invention, a copying machine incorporating the automatic original feeding device is substantially comprised of means for detecting the jammed original in the original-conveying path and means for discharging copying papers from the image transference process of the copying mechanism when the jammed original is detected and simultaneously causing the value of the copied-paper counter to reset to the value displayed before the jamming. Consequently, manual removal of the jammed original and correction of the value of the copied-paper counter are automatically made by the automatic original feeding device embodied in the present invention, resulting in an extremely convenient copying machine.

Next, as another preferred embodiment of the present invention, the configuration and operation of the automatic original feeding device applicable to a copying machine related to the first preferred embodiment is described below.

Figure 5:
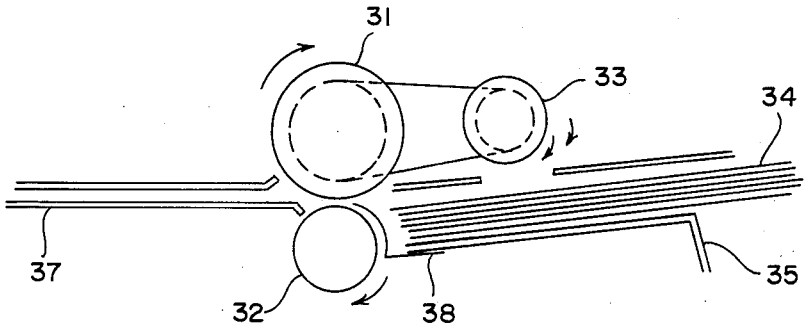
FIG. 5 is a simplified diagram of the automatic original feeding device reflecting the second preferred embodiment of the present invention.

FIG. 5 is a schematic diagram of an automatic original feeding device reflecting the second preferred embodiment of the present invention. Reference numeral 31 represents an original feeding roller rotating in a paper-forward direction. Reference numeral 32 represents a double-feeding prevention roller rotating in a paper-reverse direction. A specific gap almost corresponding to the thickness of the original is provided between both rollers. In accordance with the preset rotation speed of these rollers and the friction coefficient between the original and the rollers, the device provides the original feeding roller 31 with greater force for conveying original 34 than is provided for the double-feeding prevention roller 32. The reference numeral 33 represents an auxiliary roller for delivering original 34 between rollers 31 and 32, which can be moved vertically by a plunger (not shown). Reference numerals 35 and 37 respectively represent an original-guide plate and an original-guide path. Reference numeral 38 represents a plastic guide sheet provided at the edge of the original-guide plate 35. As shown in FIG. 5, the guide sheet 38 is bent over the surface of the double-feeding prevention roller 32 to form an arch, and its leading edge is set to a position almost as high as the top of roller 32. According to the configuration shown in FIG. 5, the leading edge of the original 34 forwarded by the auxiliary roller 33 is first led along the guide sheet 38 to a position between the original feeding roller 31 and the double-feeding prevention roller 32. The front surface of original 34 then comes into contact with the original feeding roller 31 while the back surface comes into contact with the double-feeding prevention roller 32. As a result, this original 34 is delivered to the original-guide path 37 by the conveying force of original-feeding roller 31. As mentioned above, since the original 34 is securely led to a position between rollers 31 and 32 without its leading edge coming into contact with the double-feeding prevention roller 32 during transport, the leading edge of the original can avoid being folded or damaged.

Figure 6:
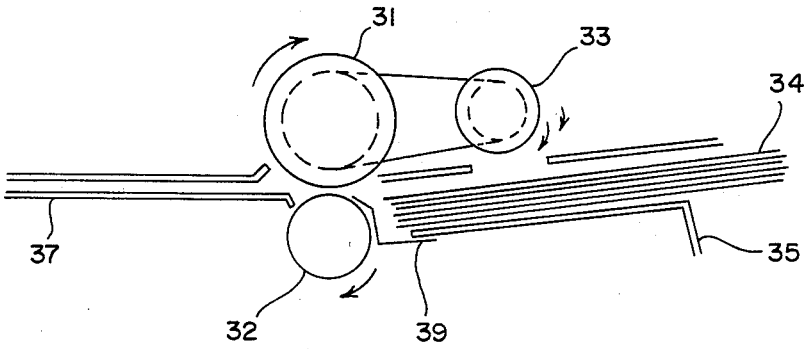
FIG. 6 is a schematic diagram of the third preferred embodiment of the present invention.

FIG. 6 shows another preferred embodiment of a guide sheet 39. In summary, the guide sheet 39 may be of any configuration that can securely prevent the leading edge of the original forwarded by the auxiliary roller 33 from coming into contact with the double-feeding prevention roller 32 during its transport.

As is clear from the foregoing description, the third preferred embodiment of the present invention provides an automatic original feeding device, featuring means for guiding the leading edge of the original to a position between the forward rotating original feeding roller 31 and the paper-backward rotating double-feeding prevention roller 32 so that the leading edge of the original does not come into contact with roller 32, that securely prevents the leading edge of the original from being either folded or torn during transport.

While only certain embodiments of the present invention have been described, it will be apparent to those skilled in the art that various changes and modifications may be made therein without departing from the spirit and scope of the present invention as claimed.

What is claimed is:

1. A copying machine comprising:

means for detecting a jammed original in an original paper conveying path; and means for first discharging copy paper utilized in an image transference process from the copying machine upon detection of said jammed original and for subsequently causing the value of a copied-paper counter to return to the value displayed before the paper jammed.

2. An automatic original feeding device provided with a paper-forward rotating original feeding roller and a paper-reverse rotating double-feeding prevention roller, which rollers are spaced apart from and face each other so that an original can be forwarded to a position between said rollers comprising:

guide means positioned between said rollers for guiding the leading edge of the original to a corresponding position between said roller without causing the leading edge of said original paper to come into contact with said paper-reverse rotating double-feeding prevention roller.

3. A copy machine comprising:

an original paper conveying path;

means for conveying an original paper through said paper conveying path;

means for detecting a jammed original in said original paper conveying path;

a copy paper conveying path;

means for discharging a copy paper to the exterior of said copying machine from said copy paper conveying path;

a copied-paper counter for incrementally counting a number of original papers being copied according to a number of copied papers discharged from said copy paper conveying path;

means, responsive to said means for detecting a jammed original, for first discharging copy paper during an image transference process from the copying machine, for temporarily interrupting said means for conveying an original paper through said paper conveying path, and for returning the value of the copied-paper counter to the value displayed before the paper jam is detected.

* * * * *